US006281849B1

(12) United States Patent
Brachat

(10) Patent No.: US 6,281,849 B1
(45) Date of Patent: Aug. 28, 2001

(54) PRINTED BI-POLARIZATION ANTENNA AND CORRESPONDING NETWORK OF ANTENNAS

(75) Inventor: Patrice Brachat, Nice (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 09/620,299

(22) Filed: Jul. 20, 2000

(30) Foreign Application Priority Data

Jul. 30, 1999 (FR) ..... 99 10105

(51) Int. Cl.[7] ..... H01Q 1/38; H01Q 9/28

(52) U.S. Cl. ..... 343/700 MS; 343/795; 343/824

(58) Field of Search ..... 343/700 MS, 795, 343/793, 824

(56) References Cited

U.S. PATENT DOCUMENTS 5,872,545 * 2/1999 Rammos ..... 343/700 MS
6,084,548 * 7/2000 Hirabe ..... 343/700 MS

FOREIGN PATENT DOCUMENTS 654 845 5/1995 (EP) ..... H01Q/9/06

OTHER PUBLICATIONS

French Search Report.

* cited by examiner

*Primary Examiner*—Don Wong
*Assistant Examiner*—Hoang Nguyen
(74) *Attorney, Agent, or Firm*—Merchant & Gould PC

(57) ABSTRACT

The invention relates a printed bi-polarization acrial comprising first, second and third superimposed substrate lates (1, 2. 3); a first metal deposit (4), situated on the external face of said first substrate plate (1) which defines at least one first radiating element (5, 6) of the dipole type, in the form of a T, the horizontal bar of said T being constituted by two radiating lateral strands separated by a coupling slit; a first power supply line (7) pursuant to a first polarization, situated between said first and second substrate plates (1, 2) and supplying power to said at least one first radiating element (5, 6); a second metal deposit (8). situated on the external face of said third substrate plate (3) and defining at least one second radiating element of the dipole type (9, 10), in the form of a T, the horizontal bar of said T being constituted by two radiating lateral strands separated by a coupling slit; a second power supply line (11) pursuant to a second polarization, situated between said second and third substrate plates (2, 3) and supplying power to said at least one second radiating element (9, 10).

14 Claims, 6 Drawing Sheets

| MESURE RADOME: | |
|---|---|
| NORME À -3,45 dB DÉPOLARISÉ DE 90 DEGRÉS | |
| Fr = 980 Mhz - ACCÈS 1 | fd01tp |

| MESURE RADOME: | |
|---|---|
| NORME À -3,4 dB DÉPOLARISÉ DE 0 DEGRÉ | |
| Fr = 980 Mhz - ACCÈS 2 | fd08tp |

PRINTED BI-POLARIZATION ANTENNA AND CORRESPONDING NETWORK OF ANTENNAS

The field of the invention is that of microwave antennas.

More precisely, the invention relates to a printed bi-polarization antenna as well as a corresponding network of antennas.

The antenna according to this invention has numerous applications. For example, it can be used as a probe in a device for testing an antenna by measurement of radio wave radiation. It will be recalled that such devices notably enable one to make forecasts of radio wave coverage, to carry out measurements on equipment (mobile or otherwise) with a view to establishing conformity to standards, to check the security of transmitted, wanted signals and to make measurements used for the study of the interactions between radio waves a n d people.

It may also be used in the field of telecommunications, for example in the base stations of a radio communications system (GSM or otherwise), or in a multi-media satellite receiver.

In all these applications, in a traditional way it is desirable that the antenna used has an omnidirectional radiation diagram (as close as possible to an infinitesimal dipole), a broad band width and excellent purity of polarization.

In the context of this invention, it is desirable, in addition, that the antenna should be a double polarization antenna. In effect, it has been noted that this type of duplex polarization antenna is in oeneral use.

Because of this general use, it is also true that an antenna test device requires the use of duplex polarization probes, that is to say, probes capable of measuring two orthogonal components of an electrical field. In effect, the measurement carried out by the test device must, in particular, provide the characteristics of the antenna under test, under polarization isolation conditions. It can therefore be understood that the probe itself must have excellent isolation between its accesses and provide cross-over polarization levels that are very low.

Traditionally, as measurement probes, open or horn guide type antennas are used. However these have a large "thickness" (5 to 10 wavelengths $\lambda$) which has a redhibitory effect when used in frequency bands below 3 GHz.

So as to resolve this problem of space and size, certain attempts have been made to use printed technology. In effect, one of the major interesting features of this technology is to permit the production of antennas that occupy only a small volume (the thickness remaining generally of the order of $\lambda/4$) and have a low weight. In addition, through the literature, numerous structures for printed, duplex polarization antennas are known.

However, in practice, at the present time, no printed bi-polarization antenna exists that has an omni-directional radiation diagram, a broad band width and excellent polarization purity. In effect, they are all, at the present time, based on metallic resonant patches powered by coupling (lines or punched out slits in a ground plane) or by contact (coaxial probes). However the use of resonant patches unfortunately leads to reduced band widths (rarely more than 20% with the SWR (Stationary Wave Ratio) less than 2). Known printed antennas only meet two out of the three criteria (namely an omni-directional radiation diagram and purity of polarization), and are therefore not suitable for the applications mentioned above.

An objective of the invention is to remedy these various disadvantages in the state of the technology.

More precisely, one of the objectives of this invention is to provide a printed bi-polarization antenna having not only an omni-directional radiation diagram and excellent polarization purity, but also a broad band width (for example greater than 50% with the SWR<2).

The invention also has the objective of providing such an antenna capable of operating in circular polarization.

Another objective of the invention is to provide such an antenna having augmented directional selectivity.

These various objectives and others that will become apparent in what follows, are achieved in accordance with the invention using a printed bi-polarization antenna comprising:

first, second and third superimposed substrate plates;

a first metal deposit, situated on the external face of said first plate which defines at least one first radiating element of the dipole type, in the form of a T, the horizontal bar of said T being constituted by two radiating lateral strands separated by a coupling slit;

a first power supply line pursuant to a first polarization, situated between said first and second substrate plates and supplying power to said at least one first radiating element;

a second metal deposit, situated on the external face of said third substrate and defining at least one second radiating element of the dipole type, in the form of a T, the horizontal bar of said T being constituted by two radiating lateral strands separated by a coupling slit;

a second power supply line pursuant to a second polarization, situated between said second and third substrate plates and supplying power to said at least one second radiating element.

The general principle of the invention consists therefore of superimposing at least one first printed T-shaped dipole and at least one second printed T-shaped dipole, each having a distinct polarization. Thereby, a structure with three substrate layers and four metal coating layers (two for the radiating elements and two for the power supply lines) is obtained. This topology avoids physical intersections between the power supply lines and therefore limits the dangers of parasitic couplings.

In this way, the bi-polarization antenna according to the invention benefits from all the advantages associated with the printed T-shaped mono-polarization dipole, namely low volume, easy mechanical maintenance, an omni-directional radiation diagram and a broad band width (greater than 50% with SWR<2).In addition it is a technology that is simple to implement.

For a detailed description of the printed T-shaped dipole, reference can be made, in particular to French patent No. 93 14276, the text of which is introduced here as a reference.

It should be noted that the small volume occupied by the antenna according to the invention (in particular its small thickness) makes it particularly suitable for the test devices mentioned above and particularly for near-field devices. It may be recalled that the latter enable one to measure the radio field emitted at a short distance through the use of a n electronic apparatus (under test). Such measurements aim to provide better knowledge of propagation phenomena at short distance from electronic equipment and enable one to provide evidence of interactions between the waves radiated by the equipment and the human body (which is often made difficult by the extreme proximity of the equipment).

In a preferred embodiment of the invention, said first metal deposit defines two first radiating elements of the dipole type, each in the shape of a T and joined to one another through the free end of the vertical bar of each T. Said first power supply line has two arms each supplying one of the two first radiating elements. Said second metal deposition defines two second radiating elements of the dipole type, each in the shape of a T and joined to one another through the free end of the vertical bar of each T. Said second power supply line has two arms each supplying one of the two second radiating elements.

By joining radiating elements in a T, associated two b y two, with one and the same polarization, geometric symmetry is introduced which enables improvements to be made in the purity of polarization (cross-over polarization levels which are very small) and in the isolation between accesses.

Preferably, the longitudinal axis of the Ts of said first radiating elements is offset by about 90° with respect to the longitudinal axis of the Ts of said second radiating elements.

In this way, a level of additional symmetry is introduced which allows improvements to be made in the purity of polarization and the isolation between accesses.

In an advantageous way, the vertical bar of the T of each radiating element constitutes a ground plane for at least a part of said first and second power supply lines. The vertical bars of the Ts of the first elements thereby constitute a first ground plane, while the vertical bars of the Ts of the second elements thereby constitute a second ground plane. Hence, the power supply lines function as striplines and are therefore shielded (they are between the first and second ground planes). This suppresses the problems of leaks and of parasitic diffractions, which would be liable to cause a deterioration in performance (in particular in the purity of polarization) of the overall structure.

The invention also relates to a two band, printed antenna with double polarization in each band.

The invention also provides the networking of the antenna described above in such a way that increased directional selectivity is obtained.

Other characteristics and advantages of the invention will become apparent on reading the following description of a preferred embodiment of the invention, given by way of an illustrative and non-limitative example together with t h e appended drawings in which.

The invention therefore relates to a printed bi-polarization antenna. In the description that follows the case of horizontal and vertical polarizations is considered. It is clear 30 however that the invention is applicable to other types of double polarization (polarizations at ±45° for example).

Figure 1:
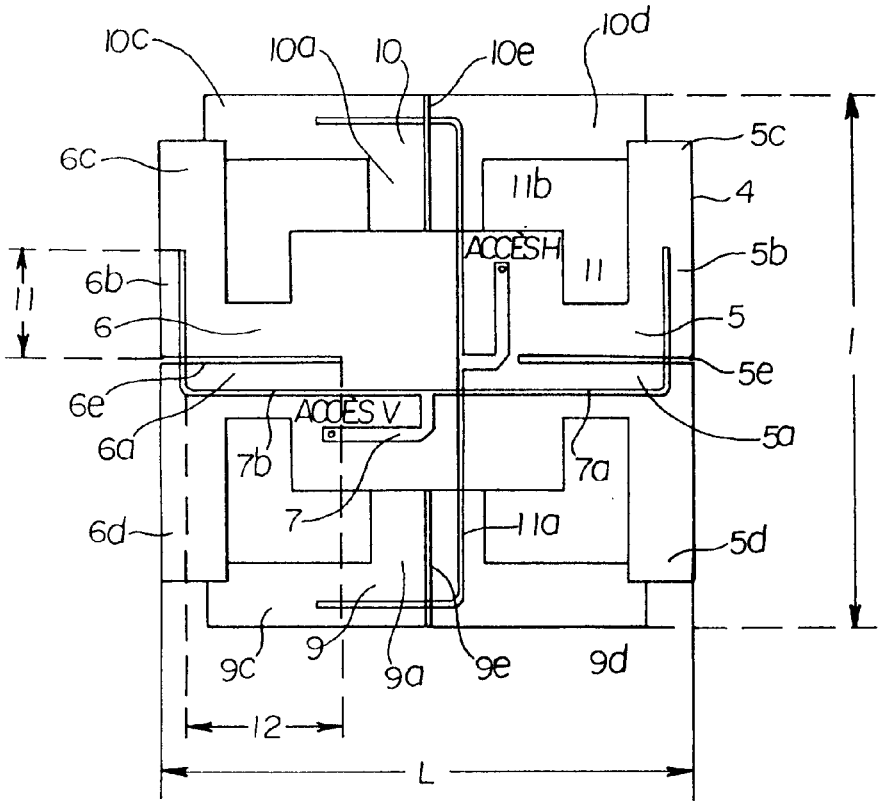
FIG. 1 is a view from above that nevertheless makes apparent the various superimposed layers that constitute a preferred embodiment of the antenna according to the invention.
Figure 2:
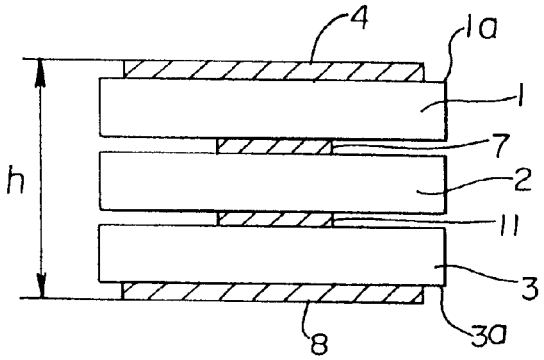
FIG. 2 is a side view of the antenna in FIG. 1.

As illustrated in FIGS. 1 and 2, in a preferred embodiment, the antenna according to this invention comprises first, second and third superimposed substrate plates 1 to 3, (shown only in FIG. 2);

a first metal deposit 4, situated on the external face 1*a* of the first substrate plate 1 and defining two first radiating elements 5, 6 of the dipole type, each in the shape of a T and joined to one another through the free end of the vertical bar 5*a*, 6*a* of each T, the horizontal bar 5*b*, 6*b* of each T being constituted by two lateral radiating strands 5*c*, 5*d* and 6*c*, 6*d* separated by a coupling slit 5*e*, 6*e;* a first power supply line 7 pursuant to a first polarization situated between the first and second substrate plates 1, 2 and having two arms 7*a*, 7*b* (thanks to a divider (into two) not shown) that each supply power to one of the two first radiating elements 5, 6;

a second metal deposit 8, situated on the external face 3*a* of the second substrate plate 3 and defining two second radiating elements 9, 10 of the dipole type, each in the shape of a T and joined to one another through the free end of the vertical bar 9*a*, 10*a* of each T, the horizontal bar 9*b*, 10*b* of each T being constituted by two lateral radiating strands 9*c*, 9*d* and 10*c*, 10*d* separated by a coupling slit 9*e*, 10*e;* a second power supply line 11 pursuant to a second polarization situated between the second and third substrate plates 2, 3 and having two arms 11*a*, 11*b* (thanks to a divider (into two) not shown) that each supply power to one of the two second radiating elements 9, 10.

The first power supply line 7 has a first access (designated "access V" for a vertical access in Figure 1) Similarly, the second power supply line 11 has a second access (designated "access H" for a horizontal access in FIG. 1).

Each of the accesses H, V for the power supply lines 7, 11 is for example, connected to a connector (not shown) of the SMA type (or some other) itself connected to a coaxial cable.

The longitudinal axis of the Ts of the first radiating elements 5, 6 is offset by about 90° with respect to the longitudinal axis of the Ts of the second radiating elements 9, 10. Hence one has a perfectly symmetrical topology, in the form of a cross. In other words, the first and second metallic deposits 4, 8 have, in this example, the same shape (including the central conducting surface with a square shape which is discussed below), and are simply offset by a quarter of a turn with respect to one another.

The vertical bars of the Ts of the first radiating elements 5, 6 constitute a first ground plane for the first and second power supply lines 7, 11 (and in particular for the divider (by 2) included in each of the latter). Similarly, the vertical bars of the Ts of the second radiating elements 9, 10 constitute a second ground plane for the first and second power supply lines 7, 11 (in particular for the divider (by 2) included in each of the latter). The first and second power supply lines therefore function as stripline elements. The free end of each of these vertical bars of a T is widened, in such a way that the surface area of the ground planes is increased. In the example illustrated, the widening means that at the center of each of the first and second metallic deposits 4, 8, a conductive surface with a square shape is obtained.

Each of the arms 7*a*, 7*b*, 11*a*, 11*b* of a power supply line has a first end portion extending along an axis that intercepts the axis of the slit of one of the radiating elements and overlapping the axis of the slit of one of the radiating elements with a first variable matching length (or series stub) 11.

Furthermore, the slit of each of the radiating elements has a second end portion that overlaps the axis of the second variable matching length (or parallel stub) 12. For reasons of clarity, the 30 first and second matching lengths 11, 12 are only given reference numbers in FIG. 1 for one of the power supply arms (that with reference number 7*b*). A suitable choice for these series and parallel stubs 11, 12 enables one to match the relevant radiating element over a broad band.

The antenna may, in addition, include variable capacitance means (not shown), enabling one to act electrically on the first and second variable matching lengths (series and parallel stubs) of each of the radiating elements. It will b e recalled that this electrical action has the same effect as a physical (that is to say real) action, lengthening or shortening the stub on which one is acting. Examples of such means with variable capacity are described in detail in French patent No. 93 14276 to which one may refer.

Now, in relation to FIGS. 3 to 7, performance data will be given, of an example of an antenna according to the preferred embodiment described above. In this example, the antenna has the following characteristics:

size (cf. FIGS. 1 and 2): L=160 mm, l=160 mm and h=45 mm;

substrate: Duroïd type glass teflon, with relative permittivity $\epsilon_r$=2.2 and thickness 1.52 mm (for each of the three substrate plates 1, 2, 3).

Figure 3:
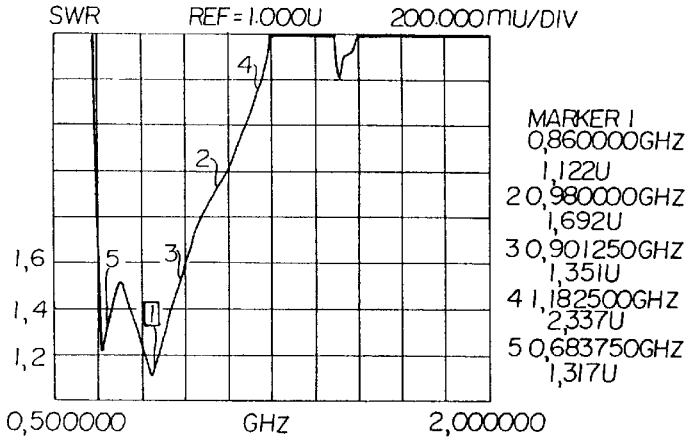
FIG. 3 is a curve showing the variation in the stationary wave ratio for the antenna in FIG. I as a function of the frequency.

This antenna is extremely broad band since it operates from 0.6 GHz to 1.1 GHz for a SWR less than 2 (cf. FIG. 3). This corresponds to more than 75% of the pass band. It will b e recalled that this percentage is obtained by division of the band width through the central frequency of this band.

Figure 4:
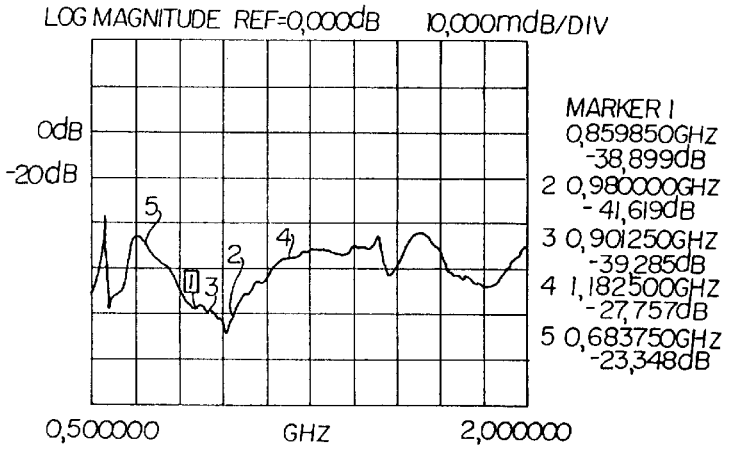
FIG. 4 is a curve showing the variation in the isolation of the accesses for the antenna in FIG. 1 as a function of the frequency.
Figure 5:
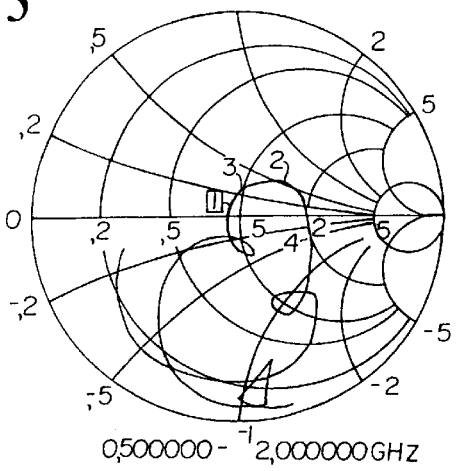
FIG. 5 is a curve showing the variation in a Smith chart, of the input impedance for the antenna in FIG. 1.
Figure 6:
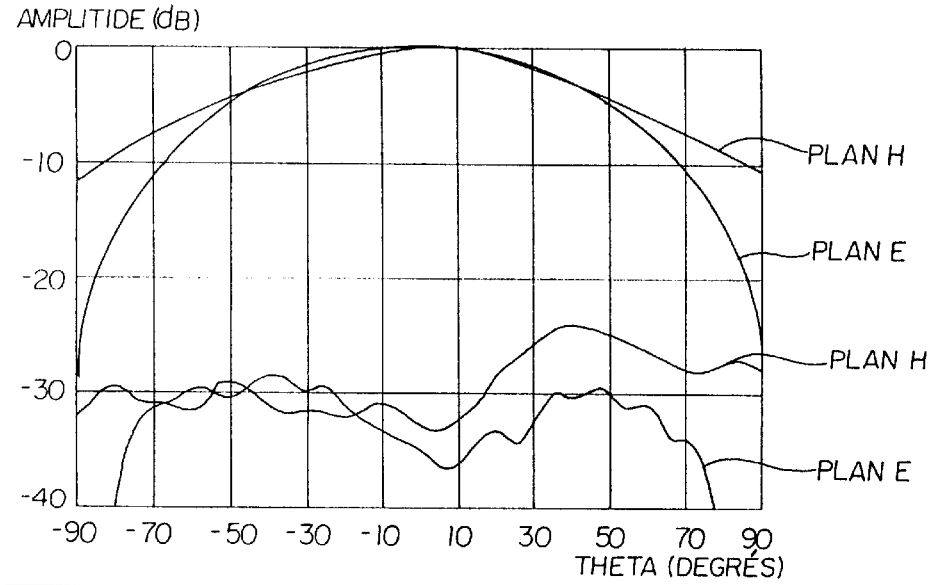
FIGS. 6 and 7 show radiation diagrams for the H and V accesses respectively for the antenna in FIG. 1.
Figure 7:
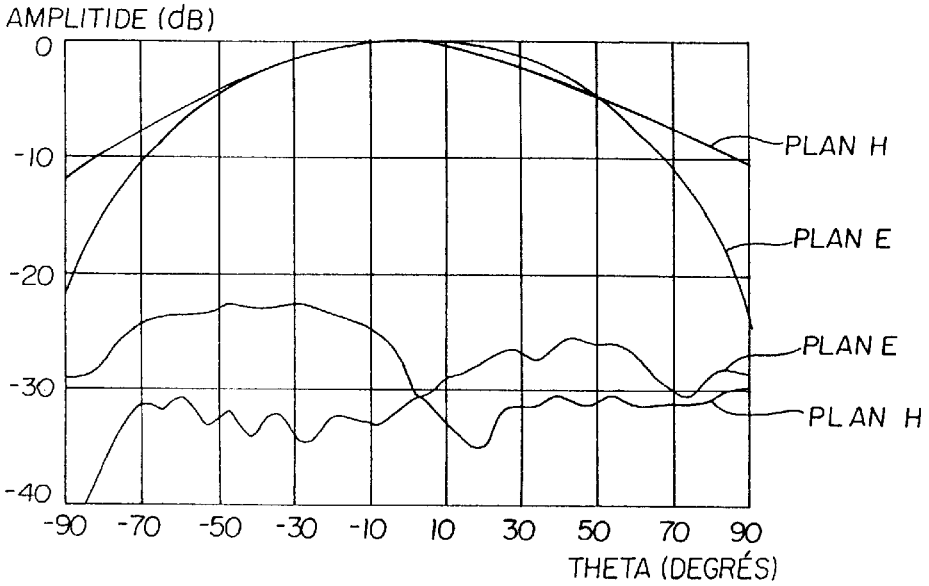
Figure 8:
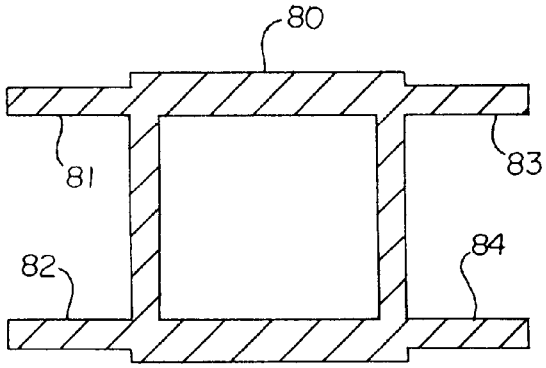
FIGS. 8, 9 and 10 show three variants of the phase displacement means that enable the antenna according to the invention to generate a circular polarization.
Figure 9:
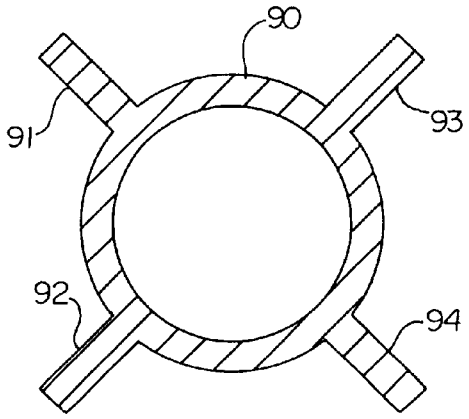
Figure 10:
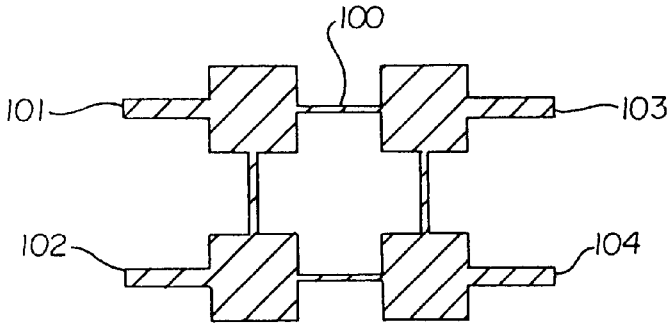

This isolation remains less than −30 dB from 0.75 GHz to 1.1 GHz (cf. FIG. 4).

Its impedance curve (cf. FIG. 5) shows a coupling loop characteristic of the dipole element, the latter being associated on the one hand with its series stub (power supply line which goes beyond the coupling slit) and on the other hand to its parallel stub (slit which extends beyond the power supply line). It is the presence of this loop which guarantees low frequency dispersion and is an expression of the efficiency of the power supply device.

Its radiation diagrams (cf. FIG. 6 and 7) have been measured at a frequency of 980 MHz. They bring to the fore, for the two accesses of the antenna, the excellent symmetry properties of the structure. The low level of cross over polarization which it generates (less than −30 dB in the axis of the element) will also be noted.

The antenna according to the invention also enables one to generate, in a simple and efficient fashion, circular polarization, supplying the couples of first 5, 6 and second 9, 10 radiating elements in quadrature. In other words, between these two couples, a phase shift of $\pi/2$ in time, is introduced. To this end, the antenna additionally includes phase displacement means.

Several variants of these phase displacement means will now be described in relation to FIGS. 8 to 11. It is clear that these examples are given purely for information purposes only, it being possible to envisage other solutions that do not depart from the scope of this invention.

A first solution (cf. FIG. 8) consists of using a hybrid element 80. This well-known hybrid element comprises two input terminals 81, 82 and two Output terminals 83, 84. In the present application an injection is made to one of the input terminals (if the antenna is operating in transmission) or one receives (if the antenna is operating in reception), either a signal in right-hand circular polarization (for example on input terminal 81), or in left-hand circular polarization (for example on input terminal 82). The output terminals 83, 84 are connected respectively to the accesses H and V of the first and second power supply lines 7, 11.

A second solution (cf. FIG. 9) consists of using a rat-race ring 90. This rat-race ring, also well known, also includes two input terminals 91, 92 and two output terminals 93, 94. It is used, within the context of the present application, in a n identical way as that described above for the hybrid element 80.

A third and more compact solution (cf. FIG. 10) consists of using isolated elements (chokes and capacitances). The corresponding assemblies (well known in themselves) 100 also include two input terminals 101, 102 and two output terminals 103, 104. They are used, within the context of the present application, in an identical way to that described above for the hybrid element 80.

Figure 11:
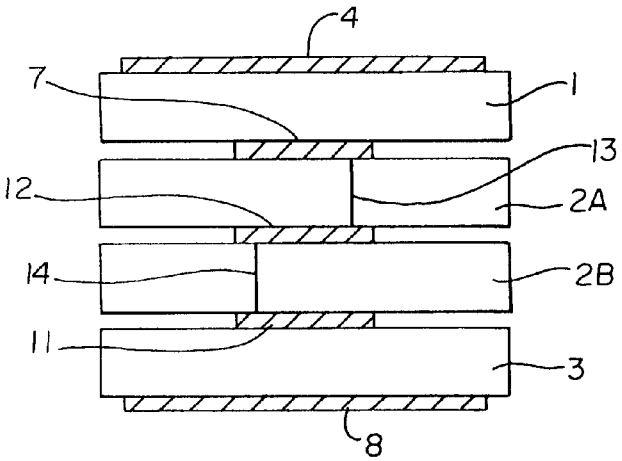
FIG. 11 shows a side view of the antenna in FIG. 1 that includes in addition the phase displacement means.

Whichever the solution adopted, these phase displacement means can be integrated into a printed circuit placed in the middle of the superimposed structure. In this case, as illustrated in FIG. 11, the second substrate plate 2 (or central plate) is divided into two sub-layers 2A and 2B, between which is placed the printed circuit (or metal deposit) that supports the phase displacement means. This printed circuit 12 is connected on the one hand to the access V of the first power supply line 7, through a first metal coated hole (or through contact) 13, and on the other hand to the access H of the second power supply line 11, through a second metal coated hole 14.

Furthermore, in an optional way, the antenna may include reflection means, that aim to increase its directional selectivity by suppressing a part of its radiation. For example, this may involve the suppression of back radiation from the antenna in such a way that the radiated energy is directed forwards and increases the directional selectivity of the antenna by a few dB while at the same time preserving broad band performance.

Figure 12:
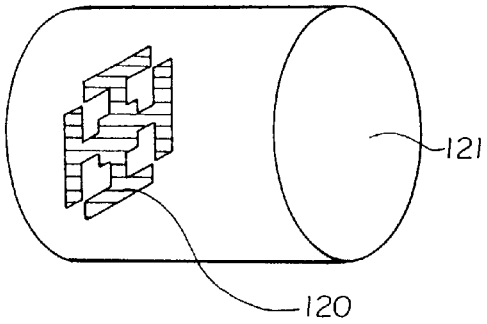
FIGS. 12 and 13 show two variants of the means of reflection that permit suppression of a part of the back radiation of the antenna of FIG. 1.
Figure 13:
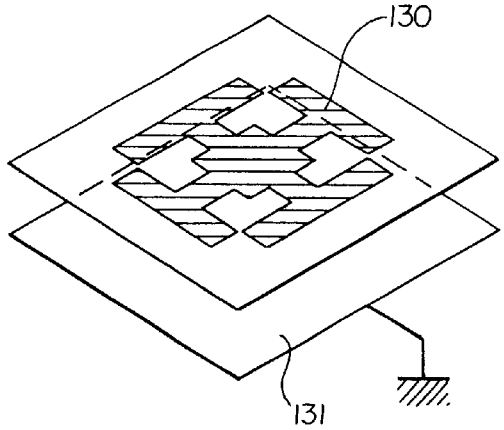

Two variants of these means of reflection will now be described in relation to FIGS. 12 and 13. It is clear that these examples are given for information purposes only, it being possible to envisage other solutions without departing from the scope of the present invention.

A first solution (cf. FIG. 12) consists of inserting the antenna 120 (such as the one previously described) in a section of a wave guide 121. This enables one to constitute a duplexed power supply system in a wave guide, in a simple way.

A second solution (cf. FIG. 13) consists of using a ground plane 131 at about $\lambda/3$ from the antenna 130 (such as that previously described). It will be noted that the radiation diagrams shown in FIGS. 6 and 7 were obtained in the presence of a ground plane.

It is also possible, in order to enhance the provision of increased directional selectivity to put the antenna, such as the one described above, into a network. In other words, t h e antenna then constitutes the base element of the network.

Figure 14:
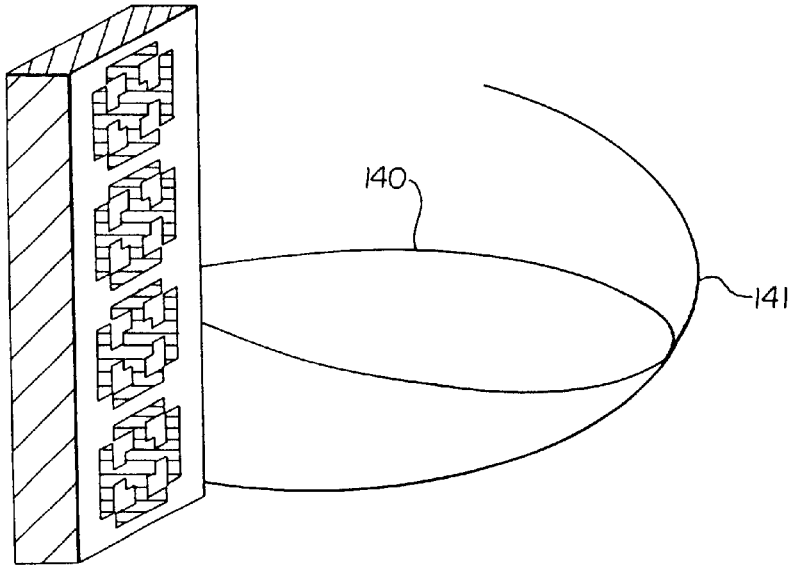
FIGS. 14 and 15 show two variants of the networking of the antenna in FIG. 1.

In relation to FIGS. 14 and 15, two particular embodiments of such networking will now be described. It is clear that these embodiments are given for information purposes only and that diverse variants may be envisaged without departing from the scope of the invention.

In the first embodiment (cf. FIG. 14), the network is one dimensional. It has a radiation diagram that is directive in elevation (as shown diagrammatically by the arc of a circle reference number 140) and broad (indeed omni-directional) in azimuth (as shown diagrammatically by the arc of a circle reference number 141). A network having such qualities is suitable particularly for base station antennas for radiocommunication systems (for example GSM or DCS).

In the second embodiment (cf. FIG. 15), the network is flat and two dimensional. It permits a large degree of pointing down to small elevations, thanks to its elementary diagram which is less directive than that of traditional resonant printed elements (with patches). A network having such qualities is suitable for ground antennas, intended for reception within the context of multimedia applications by satellite.

Figure 15:
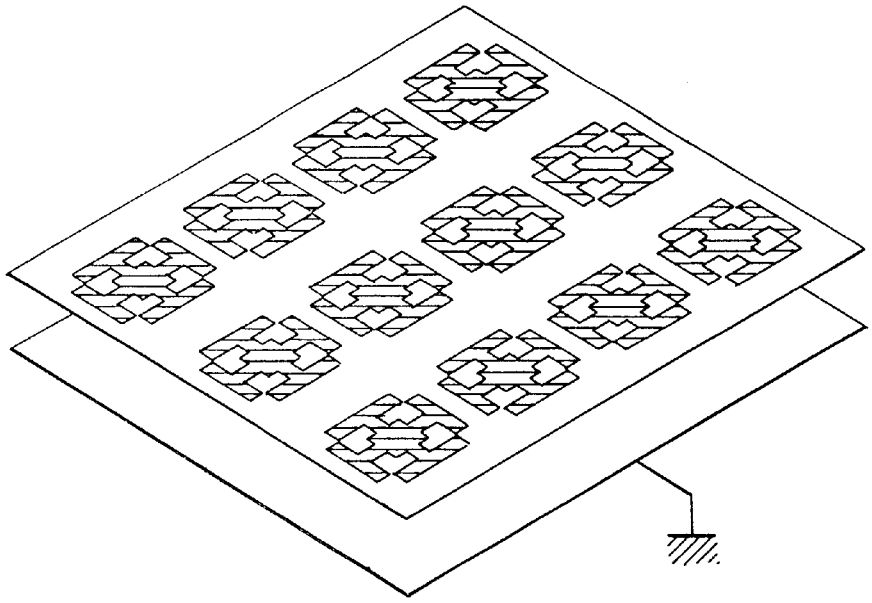

As illustrated in FIG. 15, networking can be combined with the use of reflection means (for example a ground plane).

Figure 16:
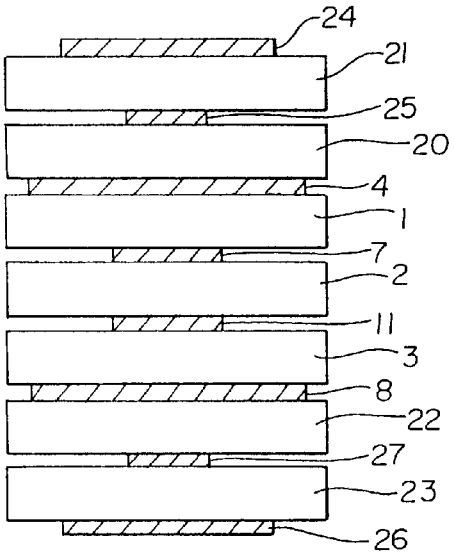
FIG. 16 shows a view from the side of a two band variant of the antenna according to the invention.

A two band variant of the antenna according to the invention will now be described in relation to FIG. 16.

At the center of the stacked structure, there are the different constituent layers (three substrate plates 1, 2, 3, two power supply lines 7, 11, and two couples of joined together, T-shaped, radiating elements 4, 8) of the antenna in FIG. 1. It is assumed that these operate in a first frequency band.

In addition, so as to allow it to operate in another frequency band, the antenna comprises the following layers:

fourth and fifth substrate layers 20, 21, superimposed against the external face of the first substrate plate 1, and sixth and seventh substrate plates 22, 2 3 superimposed against the external face of the third substrate plate 3;

a third metal deposit 24, situated on the external face of the fifth substrate plate 21 and defining a couple of third, T-shaped, radiating elements;

a third power supply line 25 pursuant to one of the two polarizations, situated between the fourth and fifth substrate plates 20, 21 which supplies power to the third radiating elements;

a fourth metal deposit 26, situated on the external face of the seventh substrate plate 23 and defining a couple of fourth, T-shaped, radiating elements;

a fourth power supply line 27 according to the other of the polarizations situated between the sixth and seventh substrate plates 22, 23 supplying power to the fourth radiating elements.

The dimensions of the third and fourth metal deposits 24, 26 which are found at the ends of the stacked structure, must be less than those of the first and second metal deposits 4, 8. In other words, the second frequency band must have a higher frequency than the first.

It is clear that, while remaining within the scope of the present invention, one may easily pass from this printed two band antenna to a printed multi-band antenna, with at least three frequency bands and bi-polarization in each band. In effect it is sufficient, for each new band, to add four substrate layers (two on either side of the stacked structure) and four metal coated layers (two for the radiating elements and two for the power supply lines).

What is claimed is:

1. A printed bi-polarization antenna comprising:

first, second and third superimposed substrate plates (1, 2, 3);

a first metal deposit (4), situated on the external face of said first substrate plate (1) which defines at least one first radiating element (5, 6) of the dipole type, in the form of a T-shape, the horizontal bar of said at least one T-shaped first radiating element being constituted by two radiating lateral strands separated by a coupling slit;

a first power supply line (7) pursuant to a first polarization, situated between said first and second substrate plates (1, 2) and supplying power to said at least one first radiating element (5, 6);

a second metal deposit (8), situated on the external face of said third substrate plate (3) and defining as least one second radiating element of the dipole type (9, 10), in the form of a T-shape, the horizontal bar of said at least one T-shaped second radiating element being constituted by two radiating lateral strands separated by a coupling slit;

a second lower power supply line (11) pursuant to a second polarization, situated between said second and third substrate plates (2, 3) and supplying power to said at least one second radiating element (9, 10).

2. The antenna according to claim 1, wherein said first metal deposit (4) defines two first radiating elements (5, 6) of the dipole type, each being T-shaped and joined to one another through the free end of the vertical bar of each said T-shaped first radiating elements, said first power supply line (7) has two arms (7*a*, 7*b*) supplying power to each of two first radiating elements, said second metal deposit (8) defines two second radiating elements (9, 10) of the dipole type, each being T-shaped and joined to one another through the free end of the vertical bar of each said T-shaped second radiating elements, and said second power supply line (11) has two arms (11*a*, 11*b*) each supplying power to one of the two second radiating elements.

3. An antenna according to claim 2, wherein the longitudinal axis of each of the T-shaped first radiating elements (5, 6) is offset by about 90° with respect to the longitudinal axis of the T-shaped second radiating elements (9, 10).

4. The antenna according to claim 1, wherein the vertical bar of each T-shaped radiating element constitutes a ground plane for at least one part of said first and second power supply lines (7, 11).

5. The antenna according to claim 4, wherein the free end of the vertical bar of at least one of the T-shaped radiating elements is widened, in a way that increases the surface area of said ground plane.

6. The antenna according to claim 1, wherein each of said power supply lines or said arms of a power supply line has a first end portion extending along an axis that intercepts the axis of the slit of one of said radiating elements and overlapping said axis of the slit of one of said radiating elements of a first variable matching length (11), and the slit of each said radiating elements has a second end portion overlapping the axis of said first end portion of a second variable matching length (12).

7. The antenna according to claim 6, comprising a means with a variable capacity, permitting electrical action to be taken on at least one of said first and second variable matching lengths of at least one of said radiating elements.

8. The antenna according to claim 1, wherein said first and second polarization forms a couple belonging to the group comprising;

horizontal polarization and vertical polarization;

polarization at +45° and polarization at −45°.

9. The antenna according to claim 1, comprising a means (80; 90; 100) of displacing the phase of said first and second power supply lines one with respect to the other, by about $\pi/2$ in time, in such a way that said antenna generates a circular polarization.

10. The antenna according to claim 9, wherein said phase displacement means belong to the group comprising:

hybrid elements (80);

"rat race" rings (90);

base solutions using localized elements (100).

11. The antenna according to claim 1, comprising a means (121; 131) of reflection that permit the suppression of a part of the radiation from said antenna.

12. The antenna according to claim 11, wherein said means of reflection belong to the group comprising:

ground planes (131);

wave guide portions (121).

13. A printed two band antenna with bi-polarization in each band, comprising the constitutive elements of an antenna according to claim 1, for bi-polarization operation in a first frequency band and for bi-polatization operation in a second frequency band;

fourth and fifth substrate layers (20, 21), superimposed against the external face of said first substrate plate (1), and sixth and seventh substrate plates (22, 23) superimposed against the external face of said third substrate plate (3);

a third metal deposit (24), situated on the external face of said fifth substrate plate and defining at least one third radiating element of the dipole type, being T-shaped, the horizontal bar of said at least one T-shaped third radiating element being constituted by two lateral radiating strands separated by a coupling slit;

a third power supply line (25) pursuant to one of said first and second polarizations, situated between said fourth and fifth substrate plates, and supplying power to said at least one third radiating element;

a fourth metal deposit (26), situated on the external face of said seventh substrate plate and defining at least one fourth radiating element of the dipole type, being T-shaped, the horizontal bar of said at least one T-shaped fourth radiating element being constituted by two lateral radiating strands separated by a coupling slit;

a fourth power supply linc (27) according to the other of said first and second polarizations, situated between said sixth and seventh substrate plates and supplying power to said at least one fourth radiating element.

14. An antenna network, comprising at least two antennas according to claim 1.

* * * * *